US005954863A

United States Patent [19]

Loveless et al.

[11] Patent Number: 5,954,863

[45] Date of Patent: Sep. 21, 1999

[54] WET AND DRY VACUUM WITH FLOAT VALVE SYSTEM

[76] Inventors: Michael L. Loveless; Colleen G. Loveless, both of 449 E. 200 North, Price, Utah 84501

[21] Appl. No.: 09/026,411

[22] Filed: Feb. 19, 1998

Related U.S. Application Data

[63] Continuation-in-part of application No. 08/752,173, Nov. 18, 1996, abandoned.

[51] Int. Cl.[6] ..... B01D 45/12

[52] U.S. Cl. ..... 96/321; 96/406; 55/459.1; 55/465; 15/353

[58] Field of Search ..... 96/405, 406, 331, 96/333, 336, 337, 347, FOR 107, FOR 136, FOR 140, 348, 349, 350, 360, 338, 321, 317, 318; 15/353, 327.6; 261/DIG. 7; 55/459.1, 465

[56] References Cited

U.S. PATENT DOCUMENTS

| | | | |
|---|---|---|---|
| 3,234,713 | 2/1966 | Harper et al. | 96/331 |
| 3,994,705 | 11/1976 | Przewalski | 96/360 |
| 4,179,768 | 12/1979 | Sawyer | 15/353 |
| 4,894,881 | 1/1990 | Palmer et al. | 15/353 |
| 5,259,087 | 11/1993 | Loveless et al. | 15/327.6 |
| 5,394,587 | 3/1995 | Parise | 15/353 |

*Primary Examiner*—Jay H. Woo
*Assistant Examiner*—Robert A. Hopkins
*Attorney, Agent, or Firm*—M. Reid Russell

[57] ABSTRACT

A wet and dry vacuum that includes a housing that is open across its top end and is arranged to be covered by a removable lid wherein is mounted a vacuum source. The housing includes an inlet port to receive a vacuum hose connected therein to pull in wet or dry materials and is formed to direct such materials towards the housing inner wall, which inlet port enters the housing above a filter system that is a lower portion of an intermediate cover that connects to the lid undersurface, which intermediate cover includes an opening into the filter cage that functions as a valve seat. The filter system includes a float ball contained in a cage to float on water as is pulled into the housing during wet operations, with the float ball, when a liquid level of a certain height is present in the housing, is pulled by the vacuum source into the open seat, closing off an air flow pulled though the housing. The cage and ball are located upstream from a filter system that include primary and secondary filters with the cage formed from spaced apart vertical members that include water deflection structures secured to each rib outer surface that are, respectively, one or more straight vertical baffles or a straight vertical groove, that engage to separate water in a vacuum flow prior to its passage through the cage, and with the structure of the inlet port and including straight vertical ribs secured at spaced vertical intervals to a housing inner surface to direct water as is passed into the housing away from the cage and ball, prohibiting water from being pulled through the cage and ball into the intermediate housing as could wet the filters. This arrangement allows for the use of a same fabric material as is suitable for use in a dry vacuum for forming both the primary and secondary filters. Draining of the housing is provided through a drain assembly arranged in the housing wall that is operated to pass a controlled volume of flow that is a half tubular drain section formed in the housing bottom to drain through a valve in the housing wall.

17 Claims, 8 Drawing Sheets

WET AND DRY VACUUM WITH FLOAT VALVE SYSTEM

BACKGROUND OF THE INVENTION

The application is a continuation in part application of parent application Ser. No. 08/752,173 filed on Nov. 18, 1996 under the same title, abandoned.

FIELD OF THE INVENTION

The present invention relates to vacuum cleaners for vacuuming up both dry and water borne materials.

PRIOR ART

Vacuuming up both wet or dry materials has heretofore generally required an opening up of canister of the vacuum to change the vacuum filter when going from a dry to wet use. In that changeover, the dry filter positioned over a motor inlet is removed and replaced with a wet filter, and vice versa. Further, where, like the present invention, for a wet use, a float valve has been employed to prohibit the vacuum canister from over filling and passing water into a motor inlet, such has been covered by a filter, such as a primary filter. Unlike such earlier arrangements the present invention employs a vacuum filter that is located downstream from the float valve that need not be changed when the unit is switched from one use to the other. The present invention has been developed from and includes some of the features of, respectively, an earlier ash vacuum adapter of the present inventors, U.S. Pat. No. 4,868,949, that shows a canister arrangement for connection to a vacuum source that is arranged for drawing ashes and coals from a fireplace into a canister. Further, and a later U.S. Pat. No. 5,259,087, also of the inventors, sets out an arrangement for shaking dust off from a bag type primary filter thereof, or the like, as does a recent U.S. Pat. No. 5,704,956 of the inventors that is an improvement of this '949 patent. The '949 patent is preferably employed for removing coals and even burning coals, describes a use of a filter that is formed of a fire retardant material and provides a rod that extends to above the canister and connects to a bottom plate whereto the filter is mounted for shaking the primary filter. The '087 patent is also preferably for a use like that of the '949 patent and additionally provides for an open box frame as a filter support that the rod is attached to. In the device of the '956 patent, an operator, moving a rod, moves a connected filter support to strike a cage that is spring mounted to an undersurface of the vacuum motor mount that supports a secondary filter fitted thereover, with the secondary filter supported over the cage. The cage, is thereby flexed on spring mounts, to rebound to strike the bottom of the secondary filter, vibrating and shaking the collected particles therefrom. The dislodged particles fall to the bottom of the primary filter. The present invention while it utilizes the filter support, cage, and filters, with the filter support arranged to be shaken by moving a connected rod, as shown in the '956 patent for use as a wet and dry vacuum. Unique from the above, the present invention employs novel filter mounts and float valve arrangements where the float valve is located upstream from the filters, and provides an air inlet into the vacuum canister that is positioned and configured to direct water pulled through the float valve arrangement that includes a unique cage configuration, the air inlet and cage configurations to prohibit water traveling past float valve as could be passed into the vacuum filter system.

The invention, while it has some features that are structurally and functionally similar to the above cited '094 and '956 patents, as set out above, is distinct therefrom in that it is directed to a water flow control arrangement for a wet and dry vacuum. Further, additional vacuum devices are shown in U.S. Patents to McAllister, U.S. Pat. No. 2,211,934; to Gongwer, U.S. Pat. No. 4,355,434; to Rasmussen, U.S. Pat. No. 4,476,608, and to Natale, U.S. Pat. No. 4,613,345, that provide for connection of a device to a vacuum source for pulling in dust, ashes, or like materials. Additionally, unlike the present invention, vacuum devices that include flexible bag type primary filters with filter shaker arrangements are shown in patents to Jerabek, U.S. Pat. No. 3,358,316 and to Okun, U.S. Pat. No. 3,568,413, and in a United Kingdom Patent to Ruau, No. 294,501. None of which above set out patents and publications as cited by applicants and discovered and cited by the Examiner in the U.S. patent application that the present application is a continuation-in-part of, however, involve filter mountings, a float valve arrangement, a water inlet port and drain valve cage arrangement employing ribbing to preclude water entering the cage, that are like those of the present invention.

SUMMARY OF THE INVENTION

It is a principal object of the present invention in a wet and dry vacuum to provide a primary and secondary filter mounting that is downstream from a float valve system and further includes a vacuum inlet port located in a vacuum housing, with a use of the float valve system and vacuum inlet port configured to discourage water passing into the primary filter.

Another object of the present invention is to provide a wet and dry vacuum where the arrangement of an inlet port located in the housing positioning adjacent to a float valve assembly having a basket housing or cage and a ribbing structure thereof, discourages water pulled through the port from traveling into the float cage.

Another object of the present invention in a wet and dry vacuum is to provide a vacuum cleaner that includes a double filter system, where the filters are located downstream and are well separated from a float valve system, to preclude water from reaching either the primary or secondary filters, thereby allowing for a same fabric material to be utilized for the manufacture of both the filters, neither of which filters needs not be changed regardless of whether the vacuum is being used for wet or dry operations.

Another object of the present invention is to provide a float valve system that includes a cage configuration to center a float ball that is discouraged from being prematurely pulled into a seat formed through a closed intermediate cover that is secured to a vacuum motor mount containing the filter system and includes ribbed supports as the cage body that captures water droplets to prevent there passage through the cage.

Still another object of the present invention is to provide a vacuum drain arrangement maintained in the vacuum housing and configured to fully drain and house a flow rate from a drip to full flow when a discharge valve is operated.

Still another object of the present invention in a wet and dry vacuum is to provide, with the float valve system with ribbed cage and vacuum inlet port, an arrangement for discouraging water pulled into the vacuum body from traveling to a filter mounting, that includes a filter support maintained within a primary filter and is connected to a movable cage for engaging a secondary filter with a rod connected to the filter support fitted through a vacuum housing lid that is for manual manipulation to engage and shake both the primary and secondary filters, shaking collected particles therefrom.

Still another object of the present invention is to provide a wet and dry vacuum that does not require opening to change one or both of the filters when the vacuum is changed from wet to dry or dry to wet operations.

The present invention is in a wet and dry vacuum cleaner that includes a pail or canister housing that may be mounted on casters, wheels, or the like, and has a lid arranged for releasably fitting over the housing open top end and includes vertical ribs secured at spaced intervals therein to break up an air or air and water flow pulled into the vacuum cleaner. The lid mounts a vacuum source that is preferably an electric motor that turns a fan to pull an air flow through an open hose that is connected into the canister. The hose connects through an inlet port of the invention to pull either wet or dry materials into the canister with the flow impacting the spaced vertical ribs to dislodge dust or water particles out of the flow that fall to the canister bottom. A filter system is arranged within the housing, mounted across the vacuum motor inlet. The filter system includes an interior or secondary filter that is preferably maintained over a movable spring mounted cage arranged across the vacuum motor inlet, with an outer or primary bag type filter. The primary filter contains a filter support that is a rigid frame arranged between the outer or primary bag filter and the secondary filter. The rigid frame is connected to a rod that extends through a port in a housing top and is for shaking by an operator. A float valve system is mounted upstream and spaced apart from this filter system that includes a cage that includes ribbed supports, that along with the vacuum inlet port, are to cause collected water to flow therefrom so as to preclude that water passing through the filter system and coming in contact with the primary filter outer surface. The primary and secondary filters are each bag type filters, that are preferably manufactured from a same fabric materials, such as a polyester and one such material as has been used is manufactured by National Filter Medica Corp. known as an 18 oz. polyester scrim. Though, of course, another appropriate filter material can be so used for filter construction within the scope of this disclosure.

The float valve system includes the cage that is formed from ribbed supports and includes a housing bottom plate that is tapered or sloped from its edge to its center wherein a drain opening is formed with the cage to contain a float ball arranged to float on collected water to cover over a vacuum flow opening from the cage. The cage is open and is aligned to fit across the vacuum flow opening formed through an intermediate cover that surrounds the filter support and whereto a top end of the cage connects, with the vacuum flow opening to serve as a seat. The intermediate cover is located adjacent to a vacuum port that is formed through the vacuum housing and receives a hose connected therein. Materials are pulled through the hose and port, with that port formed to direct both wet and dry materials away from the float valve system mounted to the intermediate cover. The intake port to provide which direction is bent towards the canister wall. A water flow through the intake port is thereby directed away from the intermediate cover prohibiting its being pulled through the cage type housing of the float valve system to be pulled into the filter support.

The invention further includes vertical ribs, secured at spaced intervals in the vacuum canister walls to break up an entering flow causing entrained materials to fall to the canister bottom and a drain channel that is formed in the vacuum canister housing bottom to slope toward a variable flow valve formed through the housing wall that can be opened to drain water and captured materials. The drain channel arrangement to provide for completely draining collected water and captured materials from the housing.

The downstream arrangement of float valve cage type housing and its ribbing, and its spaced arrangement from the filter system discourages water from being pulled into the primary filter, allowing a same fabric materials to be used to from both the primary and secondary filters that need not be changed for either wet and dry operations.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
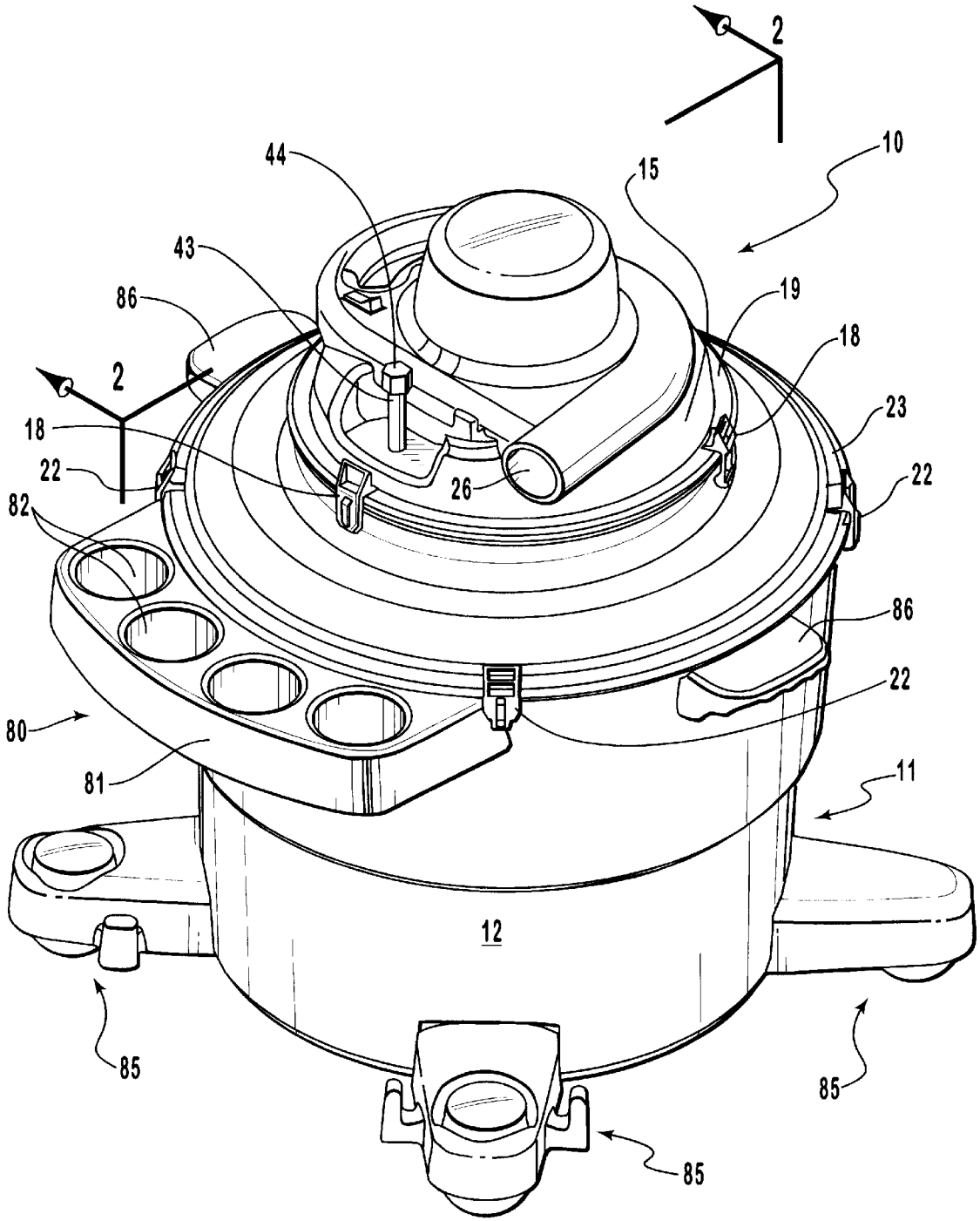
FIG. 1 is a profile perspective view of a wet and dry vacuum of the invention showing a housing with a lid fitted thereover that maintains a vacuum motor and includes an accessory tray, and showing the housing mounted on casters.

FIG. 1 shows a profile perspective view of a wet and dry vacuum 10 that includes a housing 11, that is shown as a canister or pail 12 having handles 86 extending outwardly from opposite locations of a top edge of canister 12. In use, a hose, not shown, is connected into an inlet port 70, as shown in FIGS. 2 and 3, that is formed into the side of canister 12, which hose is arranged to include a nozzle, not shown, that is fixed to its end for use in vacuuming up materials.

Figure 2:
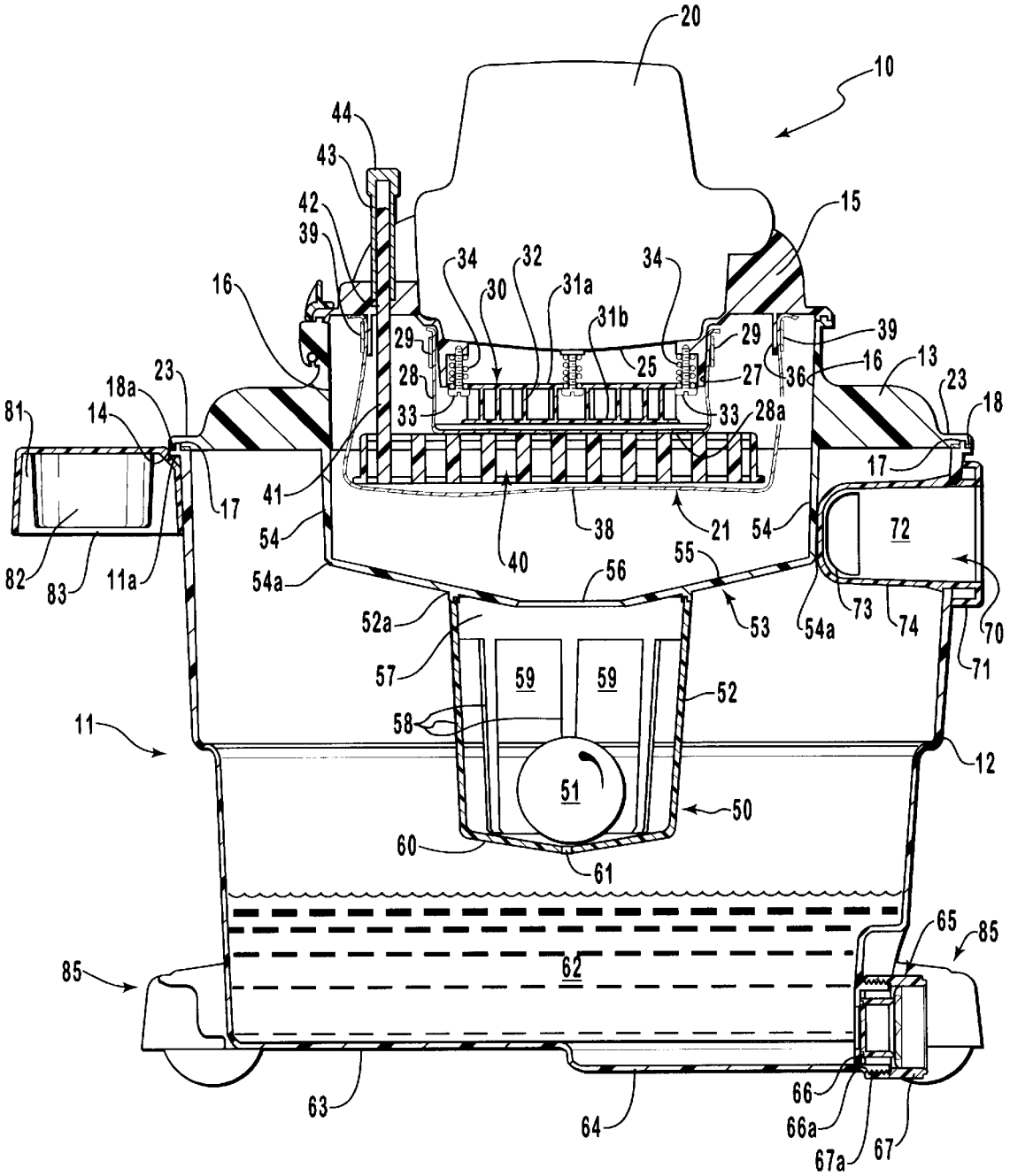
FIG. 2 is a side elevation sectional view taken along the line 2—2 of FIG. 1 showing the vacuum housing interior with an intermediate cover secured to the lid wherefrom extends a filter support that includes primary and secondary filters and mounts, across a lower end, a float ball system consisting a first embodiment of a cage type housing containing a float ball that is positioned to engage a vacuum seat formed through the intermediate cover and showing a vacuum inlet port located adjacent to the intermediate cover to direct materials exhausted therefrom towards the canister inner wall and showing a drain channel formed in the canister housing bottom that slopes toward a drain valve arranged in the housing wall to pass collected water out of the housing.
Figure 3:
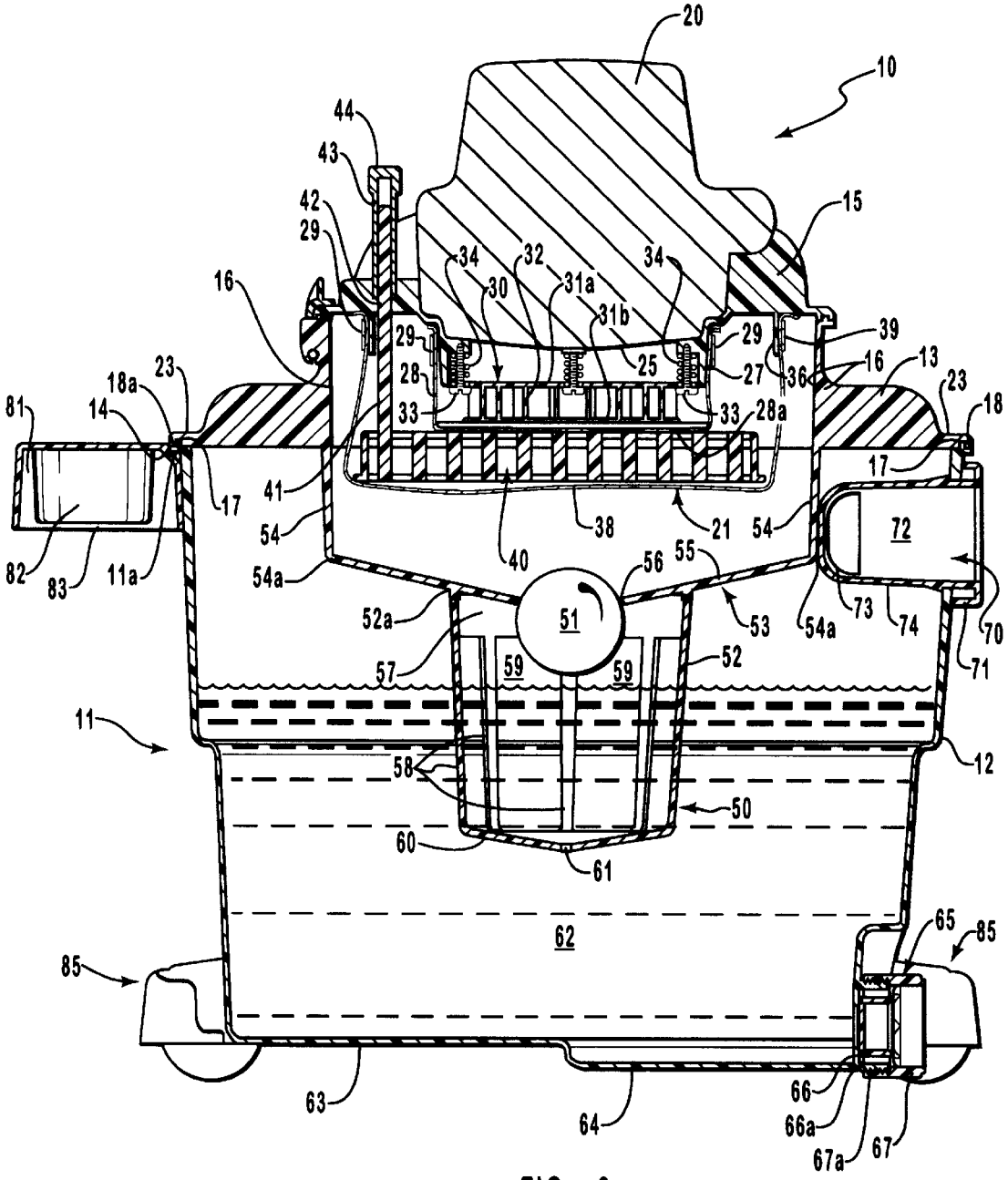
FIG. 3 is a view like FIG. 2 only showing the canister housing as having been filled with water to where the float ball has been pulled, by operation of the vacuum motor, into the vacuum seat formed in the intermediate cover, closing off a vacuum flow in the vacuum in the canister housing.
Figure 4A:
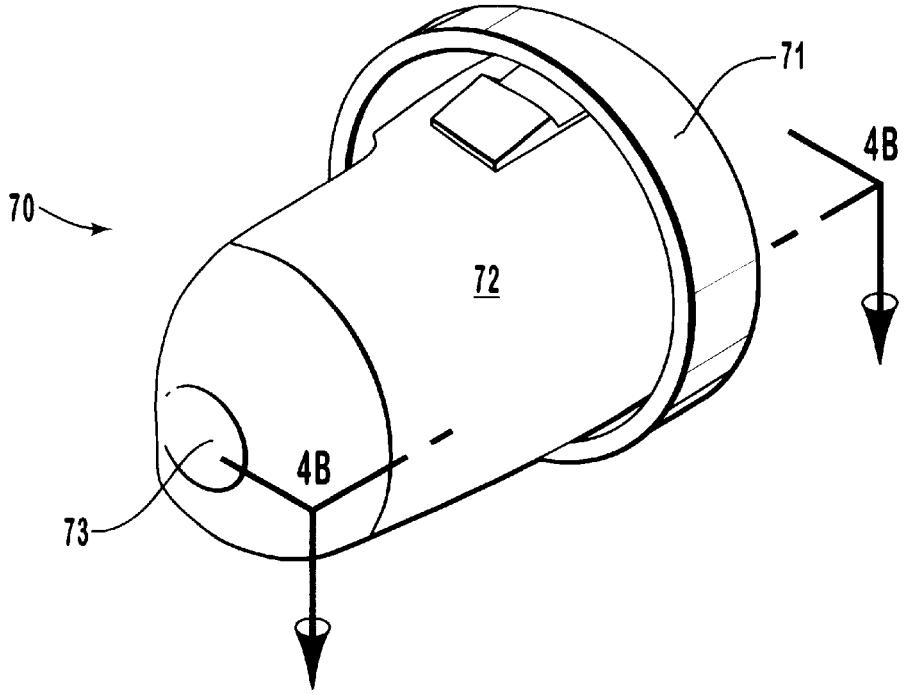
FIG. 4A is a profile perspective view taken from a forward end of the vacuum port of FIGS. 2 and 3 removed from the canister.
Figure 4B:
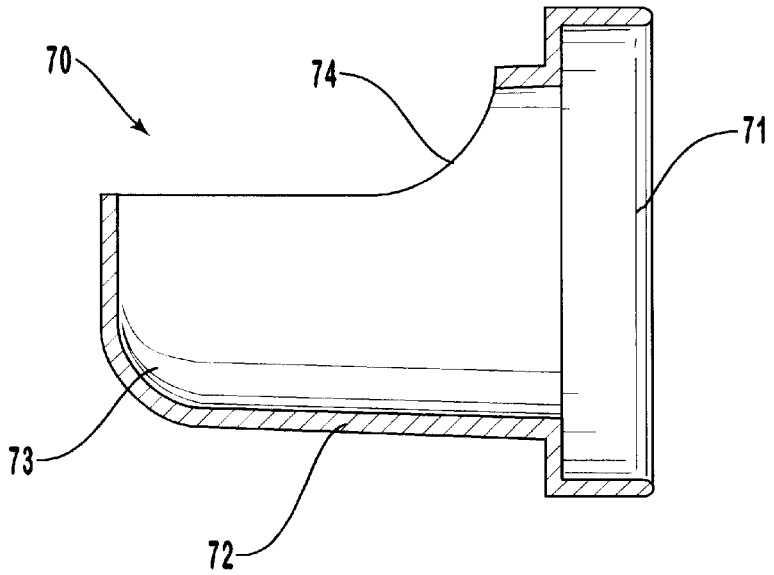
FIG. 4B is a sectional view of the vacuum port taken along the line 4B—4B of FIG. 4A.

The canister 12 has a closed bottom 63 that is open across a top edge and is turned outwardly at 11*a,* as shown in FIGS. 2 and 3, to receive and mount to a seat 14 that is formed around an outer edge of a lid 13. Which lid 13 includes a center opening 16, wherethrough a motor mount 15 is fitted. The lid 13 is for fitting over a canister 12 open top, and may include a ring gasket 18 fitted into a slot 17 to provide a sealing between the lid 13 seat 14 and the canister 12 edge 11*a*. Clamps 18 are secured at intervals around the top of the lid 13 for releasably connecting over a lip 19 of the motor mount 15, to maintain a vacuum motor 20, and with a filter system 21, secured around the motor mount center hole. Clamps 22 are provided for lid 13 coupling to the housing 11, that are preferably like clamps 18, with each clamp including a body that is pivotally coupled to the side of canister 12, adjacent to the top edge 11*a,* with the other clamp body end pivotally mounting a hook end to fit over and, when closed will grip to a lid edge 23. For clamping the lid 13 onto the canister top edge 11*a,* the hook end is pivoted so as to travel over the lid top edge 23, and the body is then pulled between parallel sides of the hook and into engagement with the canister side. So arranged, the lid 13 is releasably clamped to the canister edge 11*a,* providing a sealing engagement therebetween. This arrangement, as set out above, is shown in the earlier U.S. Pat. Nos. 5,259,087 and 5,704,956, of the inventors cited above, and the vacuum source is preferably an electric motor that is maintained through the lid 13. Accordingly, with the descriptions of the vacuums as set out in U.S. Pat. Nos. 5,259,087 and 5,704,956, are hereby adopted by this reference.

The lid 13, as shown in FIGS. 1 through 3, mounts the motor mount 15, that includes the vacuum motor 20 maintained through the center thereof The motor 20, that is preferably an electric motor, is arranged to turn a fan, not shown, to draw an air flow therethrough. In practice, a motor and fan arrangement manufactured by G.S. Electric, has been found to be suitable for this use. An electric power cord, not shown, that has a plug end for coupling into a house current source, is preferably included to provide power to the motor 20. A switch, not shown, is preferably connected electrically to that power source that, when switched on, will route electrical power to the motor 20.

An air flow is thereby pulled through the canister 12, as described, by the motor 20 turning of a fan, that pulls the air flow into the electric motor through an inlet opening 25 formed through a center of the motor 20. That air flow is exhausted out of an exhaust line 26, shown in FIG. 1 that may, but need not, receive a hose fitted thereover for use as a blower. A secondary filter cylindrical mounting collar 27, hereinafter referred to as collar, is shown in FIGS. 2 and 3 as part of a filter system 21, and is connected to extend downwardly at approximately a right angle from an undersurface of the motor mount 15, that is to receive a neck of a cylindrically shaped secondary filter 28 pulled thereover. The secondary filter is closed across its bottom end, shown as a flat section of filter material 28*a*. The secondary filter 28 neck is fitted over the collar 27 and receives a ring clamp 29 installed thereover that preferably includes a turning screw, not shown. So arranged, when the turning screw is turned, the clamp circumference is shortened to cinch it tightly against the secondary filter surface, locking it onto the collar 27. A cage 30, that is preferably round and has parallel top 31*a* and 31*b* bottom sections, that are separated by spaces 32 and is open therethrough, is arranged fitted into the secondary filter 28. Coil springs 34 are provided for mounting cage 30 to the collar 27, as shown in FIGS. 2 and 3. The coil springs 34 each receive a screw 33 that is turned into collar 27. The cage 30 is thereby spring mounted to flex against the filter 28 when a force is directed thereagainst, with that cage 30 to rebound after the force is removed, striking the secondary filter 28. So arranged, a force that is applied through the secondary filter bottom 28*a,* as set out below, will be transmitted into the cage 30 to compress the coil springs 34. Thereafter, when the applied force is removed, the cage 30 is urged by the springs 33 outwardly to contact and shake the secondary filter 28 inner surface, dislodging dust particles therefrom. In practice, the cage 30 rebounds against the inner surface of the secondary filter 28 bottom 28*a,* with the filter bottom tending to bow into the cage 30 opening. The filter bottom 28*a* then rebounds outwardly, setting up a wave to move the fabric away from and then back towards the cage 30. The cage 30 is thereby vibrated on its spring 34 mountings, to strike and dislodge particles from the filter bottom 28*a*. With filter 28, shaking dislodged particles fall into a primary filter 38, that is also a component of the vacuum 10 filter system.

Like the above set out second filter 28 mounting, the filter system 21 also includes a first or primary filter mounting 35 that incorporates an outer circular wall 36 that extends downwardly from the motor mount 15 bottom surface and is arranged to receive a ring clamp 39 fitted around a top portion of the primary filter 38, that is shown as a bag. The ring clamp 39 preferably includes a screw to be turned to cinch the top portion of the primary filter 38 against the surface of the circular wall 36. The primary and secondary filters 28 and 38, as in wet operations, are not exposed to water, can be manufactured from a same fabric material, and a fabric as has been used for this purpose is a polyester and one such material as has been used is manufactured by National Filter Media Corp., known as an 18 oz. polyester scrim supported fabric.

A filter support 40 is located within the primary filter 38, that is also a component of the filter system 21, and is preferably a flat rigid box frame that can be formed from a metal, but is preferably formed from a stiff plastic material. The box frame is open therethrough and has top edges that contact, when the filter support 40 is moved thereagainst, the outer surface of the secondary filter bottom 28*a*. So arranged, the filter support 40 is arranged to be moved to bump or strike the outer surface of the bottom 28*a* of the secondary filter 28. Such striking applies a force against the cage 30 to cause it to move against the biasing of coil springs 34. The filter support 40, as shown in FIGS. 1, 2 and 3 includes a continuous outer wall that is preferably formed as a rectangle, with rounded surfaces, and contains a straight center lateral member along with straight crossing longitudinal members that cross the center lateral member at right angles at equidistant intervals. An outwardly projecting lower lip is formed around the filter support for engaging and scrapping along an inner surface of the primary filter 38, as set out below.

To provide for moving the filter support 40, a straight rod 41 is connected thereto as by turning a threaded end of that straight rod into a threaded hole formed in the filter support, with the straight rod to extend at a right angle therefrom. The straight rod 41 is maintained to extend upwardly from a filter support narrow side, and passes through a hole 42 that is formed through motor mount 15, exiting motor mount the top surface. The straight rod 41 extends beyond the motor mount top surface for gripping by an operator, who, by moving the straight rod 41, up and down and pivoting it, moves also the filter support 40. To close over the hole 42, the hole is threaded so as to receive a threaded end of a pipe 43, shown in FIGS. 1 through 3, turned therein, with the opposite pipe end also threaded to receive a cap 44 turned thereover. The cap 44 is positioned over the end of pipe 43 to maintain, during operations, a vacuum integrity within the housing 11.

As set out above, the filter support 40 is maintained in primary filter 38 that, in turn, is maintained onto wall 36 by fitting a ring clamp 39 therearound, with the ring clamp tightened by a clamp screw, not shown, so as to cinch it tightly around the primary filter 38 top portion. So arranged, the secondary filter 28 and primary filter 38, with their mountings, and along with the filter support 40, as described, constitute the filter system 21 that is located within the canister, separating that canister interior from the vacuum source.

The above sets out a description of filter system 21 contained within the canister 12, and describes motor 20 functioning and its mounting to the canister, with the motor to pull an air flow through to systems 21. Which air flow enters the canister 12 and travels through a hose, not shown, that connects into the canister housing. This structure, along with the described primary and secondary filers 28 and 38, and their respective mountings, are upstream from the motor inlet. Which structure and the filter support 40 and rod 41 connected thereto are for shaking collected materials off from the filters, and are essentially like the structure shown and described in the earlier U.S. Patents, set out above, whose disclosure, by this reference, is hereby adopted. The present invention, distinct therefrom, provides novel and unique structural elements to enable the vacuum to be used in either a wet or dry mode, with such change in operation not requiring a changing or adjustment of either the primary or secondary filters 28 and 38, as set out below.

Figure 6:
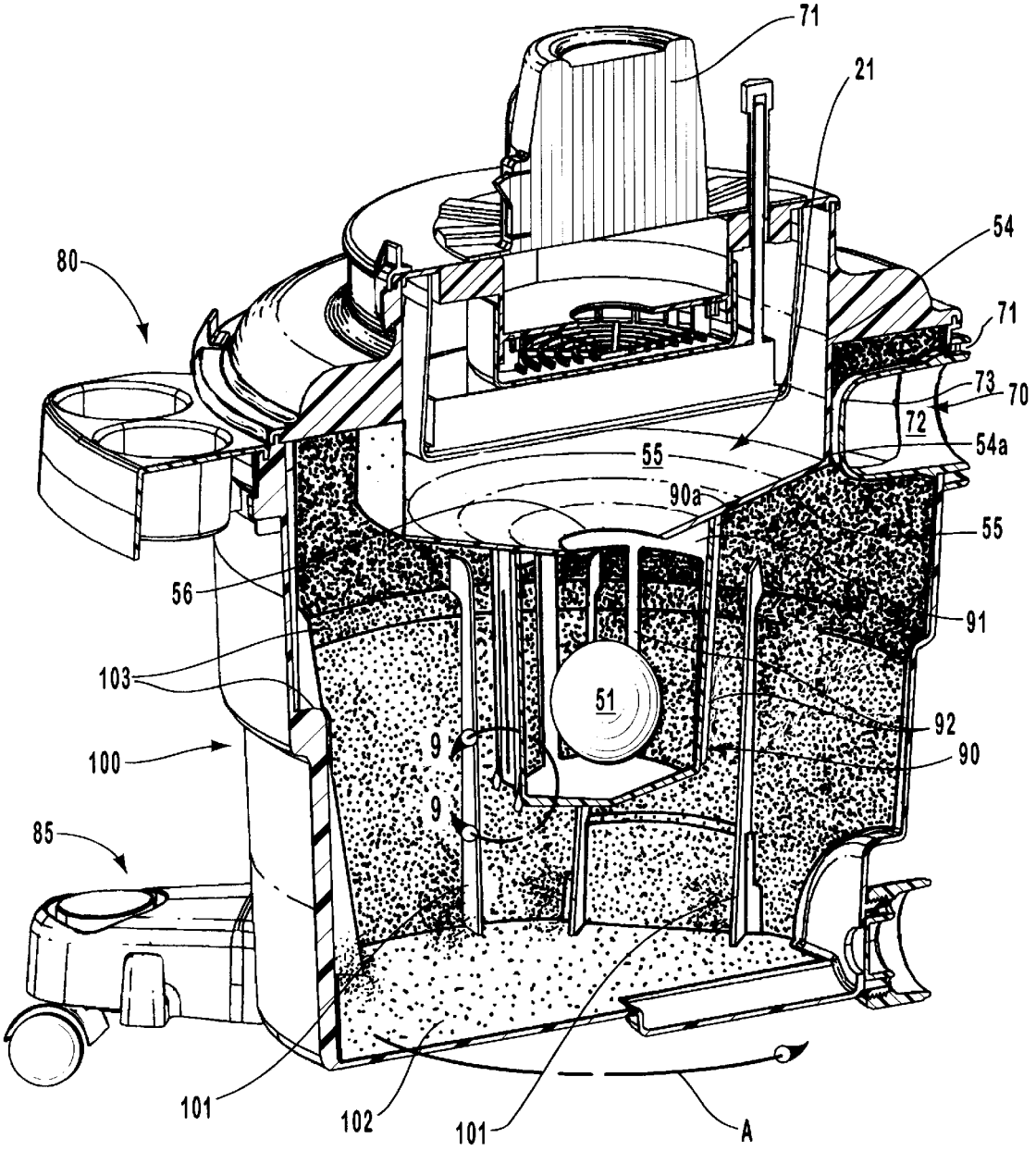
FIG. 6 is like that of FIG. 2 showing another embodiment of the wet and dry vacuum of the invention with a vertical section removed therefrom exposing a canister housing as including spaced vertical ribs and showing a filter support as including ribbed vertical members.

To function as a wet vacuum, the invention includes a float valve system 50 that is to prohibit water as is collected in canister housing 12, or a canister housing 100, shown in FIG. 6, from being pulled through the filter system 21 and into vacuum motor 20. The float valve system 50, shown in FIGS. 2 and 3, includes a float ball 51 that is maintained in a cage 52 with, in FIGS. 6 through 8C, a second embodiment of a cage 90 is shown for incorporation in float valve system 50. Distinct from earlier float valves as are commonly found in wet vacuums, the float valve 50 of the invention is located upstream from the filter system. Whereas, earlier wet vacuums have generally provided a filter arrangement for fitting around a cage of a float valve. Both the cage 52, of FIGS. 2 and 3 and cage 90 of FIGS. 6 through 8C is open therethrough, and each is secured across a top end to an intermediate cover 53 that connects the lid 13 bottom surface, around the motor inlet. An air flow is pulled by operation of motor 20, through the float valve system 50 that then passes through the filter system 21. The intermediate cover 53 includes a side wall 54 that extends, at approximately a right angle downwardly, from around the lid center opening 16. The wall 54, as shown in FIGS. 2, 3, and 6 is straight to an inward bend 54*a*, and then slopes downwardly and inwardly to terminate in a straight bottom section 55 that ends in an opening 56. The opening 56 is formed to have a slightly smaller diameter than that of the float ball 51 and is to function as a valve seat. Whereby, when the float ball 51 is pulled into the opening 56, as set out below, an air flow that is pulled by operation of the motor 20 is closed off.

Both cages 52 and 100, connect around a top edge 52*a*, and a top edge 90*a*, respectively, as shown in FIGS. 2, 3, and 6 to an undersurface of the intermediate cover 53, encircling the opening 56. The cage 52, as shown, includes a top section 57 wherefrom a number of spaced straight ribs 58 extend downwardly with spaces 59 therebetween. The spaces 59 pass water 62 pulled into the canister housing 12. A cage bottom 60 is formed to slope slightly towards the center thereof and includes a center drain hole 61, to drain from the cage from off of bottom 60. In practice, with the level of water 62 below the cage bottom 60, as shown in FIG. 2, the separation between the float ball 51 and the opening 56 is sufficient that an air flow pulled therethrough by the operation of motor 20 will not pull the ball into that opening 56. However, as the level of water 62 rises, as shown in FIG. 3, the float ball 51 that floats on that water level, at a certain or planned distance from opening 56 will lift by the air flow into opening 56, closing off that opening 56, blocking an air flow travel therethrough. An operator, hearing a change in the sound of motor 20 will realize that an air flow is no longer traveling out of the motor exhaust 26 and will then turn off the motor 20 and drain collected water, as set out below. Thereafter, the motor 20 can be turned back on.

Figure 7:
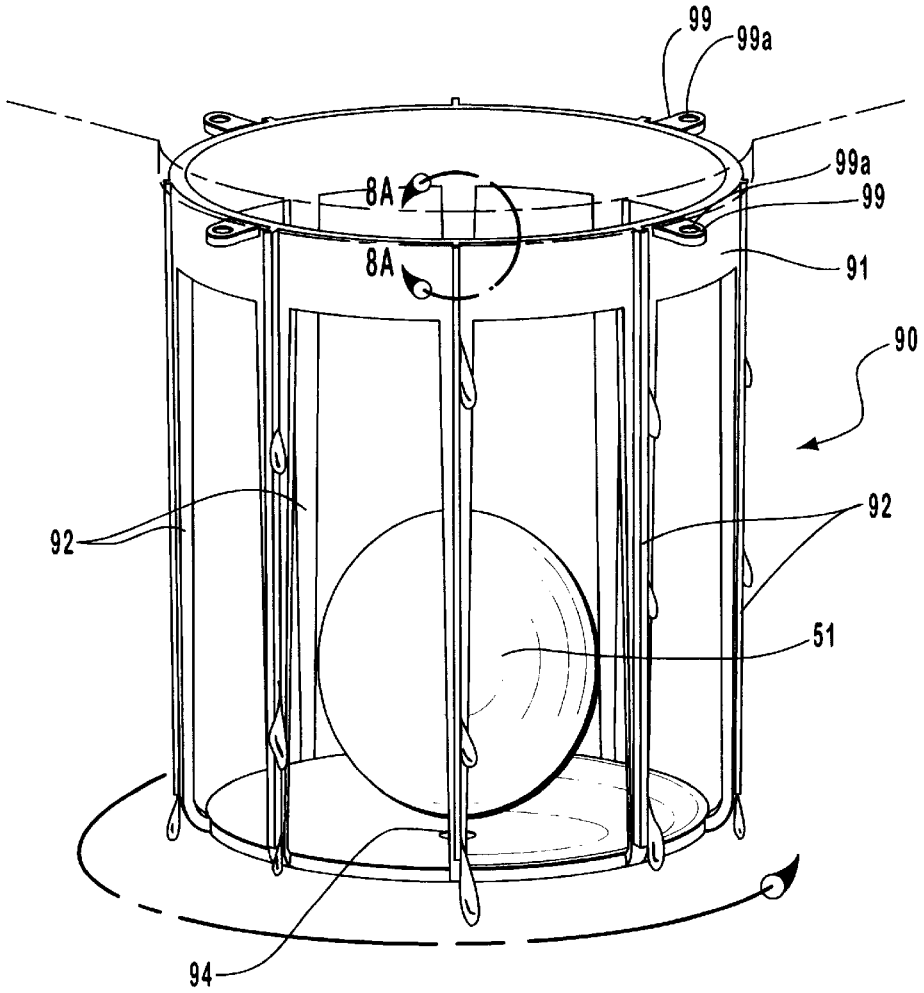
FIG. 7 is an enlarged view of the filter support removed from the intermediate cover.
Figure 8A:
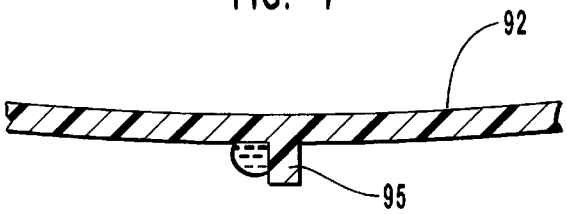
FIG. 8A is an enlarged top plan sectional view taken within the line 8A—8A of FIG. 7 show a vertical right angle rib extending from an outer face of a cage rib.
Figure 8B:
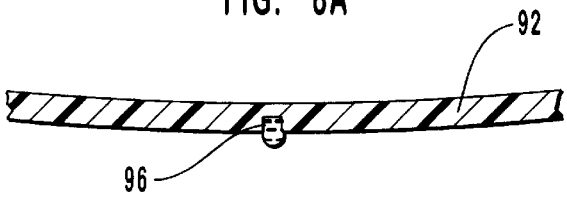
FIG. 8B is an enlarged top plan sectional view like that of FIG. 8A only showing the right angle rib as having been replaced with a groove.
Figure 8C:
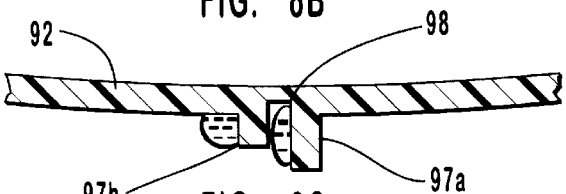
FIG. 8C is an enlarge top plan sectional view like that of FIGS. 8A and 8B only showing a pair of spaced right angle ribs of different heights extending from opposite edges of a shallow groove formed in an outer face of the cage rib.

The cage 90 of FIGS. 6 through 8C is functionally like cage 52 in that it to includes float ball 51 and is mounted to the intermediate cover 53, with the float ball 51 to fit into and close over opening 56 when the canister 100 fills with water. Unique therefrom, however, where the cage 52 includes spaced straight ribs 58 that are flat on both faces, that extend from a top section 57, cage 90 includes straight ribs 92 that each include a water deflection structure. Shown in FIG. 7, the straight ribs 92 connect between a top section 91 that is shown as a narrow sleeve, and a bottom 93 that is shown as having a concave shape and includes a center hole 94 therethrough. Water, shown as drops, as is present in a vacuum flow, arrow A, is captured by water deflection structures of each of the straight rib 92 embodiments shown in FIGS. 8A, 8B and 8C. Which water deflection structure, shown in FIG. 8A, is a right angle vertical baffle 95 secured to the center of straight rib 92, extending the length thereof With, in FIG. 8B, the water deflection structure is shown as a groove 96 extending the length of the straight rib in the center thereof Additionally, as shown in FIG. 8C, the water deflection structure may be a pair of baffles 97*a* and 97*b*, that extend the length of straight rib 92, and are of different heights, with the greater height baffle 97*a* spaced apart and down stream from the baffle 97*b* in the direction of flow, arrow A, and may include a vertical slot 98 formed between the baffles 97*a* and 97*b* to capture water therein, as shown. Shown in FIG. 7, water captured by the water deflection structures of FIGS. 8A, 8B and 8C will flow along the straight ribs 92 and drip therefrom rather than being pulled through the rib openings.

Additionally, where the cage 52 is shown in FIGS. 2 and 3 secured to the intermediate cover 53 as by a weld, or the like, the cage 90 is shown in FIG. 7 as including, along and extending at equal spaced intervals at right angles from, a top edge of top section 57, tabs 99 that each include a center hold 99*a* for receiving a fastener, such as a screw, not shown, turned therethrough for coupling the cage 90 to the intermediate cover 53, as shown in FIG. 6.

Figure 5:
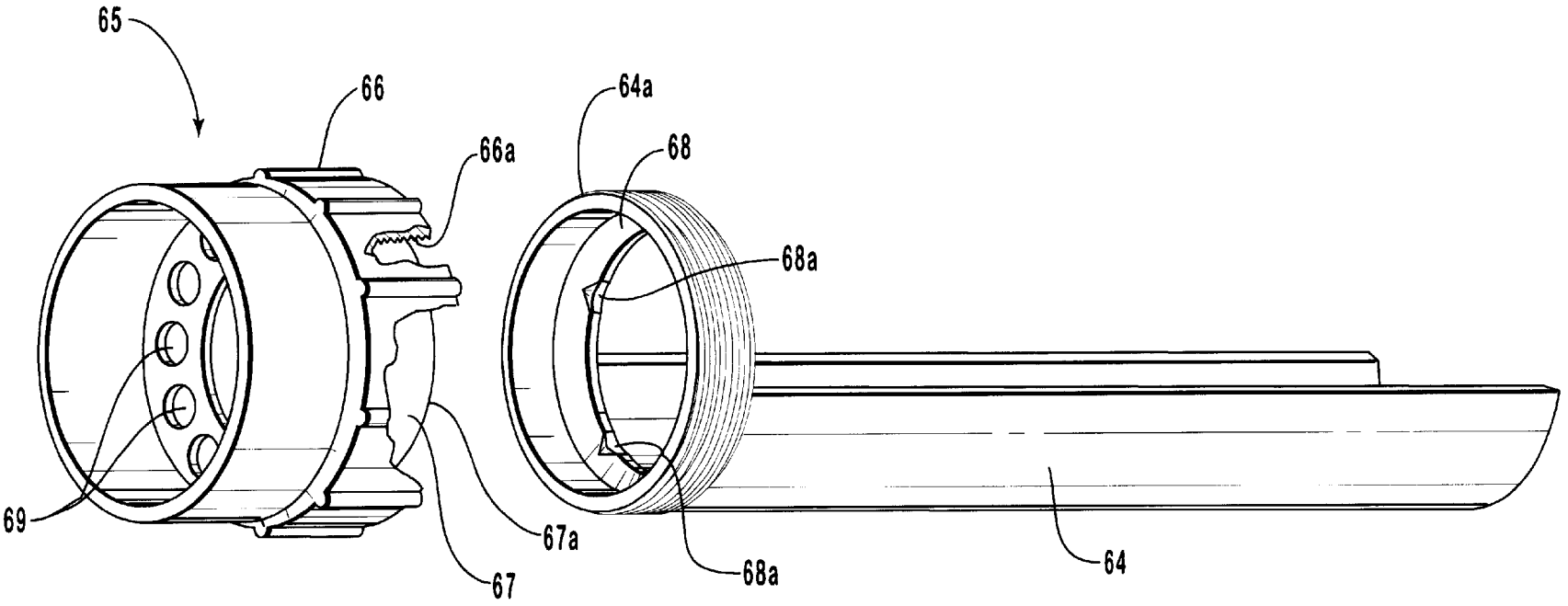
FIG. 5 is an exploded perspective view of a drain valve removed from the canister.

A preferred drain arrangement of the invention is shown in FIGS. 2 and 3, as consisting of a half tubular section 64 that is formed in a flat bottom 63 of the canister 12, to extend from the center thereof radially to a bottom edge. The half tubular section 64 may, within the scope of this disclosure, slope downwardly from the center of the canister housing bottom 63 to the bottom edge. An end of the half tubular section 64 terminates in a drain valve 65 that, as shown in an exploded view of FIG. 5, is formed to consist of an outer drain valve 65 outer sleeve 66 that internally threaded at 66*a* and has a center cylindrical stop 67 with a flat face 67*a* whose outer edge portion engages a wall 68 formed across a threaded coupling end 64*a* of the half tubular section 64. Which wall 68 is open through the center to include triangular ports 68*a* formed at ninety (90) degree intervals therearound that slope into the half tubular section. So arranged, the outer sleeve 66 threads 66*a* are turned over the tubular section 64 coupled end 64*a* to bring the stop 67 flat face 67*a* into engagement with the wall 68 around the opening therethrough. So arranged, with the sleeve 66 turned onto the coupling end 64*a* the cylindrical stop 67 center face 67*a* engages and closes off flow through the center opening triangular ports 68*a* in wall 68. By turning the sleeve 66 off of the coupling end 64*a,* the center face 67*a* is moved out of alignment over the triangular ports 68*a,* allowing flow therethrough. The amount of turning of the sleeve 66 off of the coupling end 64*a* controls the volume of flow. A spider arrangement 69, shown as a wall with a plurality of spaced apart holes therethrough, is provided for supporting the cylindrical stop 67 centered in the sleeve 66 and while not shown, a sleeve 66 exhaust end can include an arrangement for coupling a hose thereto, as desired, to direct water drained therefrom to another location. Unlike earlier wet vacuums, the half tubular section 64 and drain valve 65 provide for controlling drain flow volume and for draining water without a necessity of opening the lid 13 and pouring water therefrom.

As set out above, the wet and dry vacuum 10 of the invention is arranged to allow for a use of the same primary and secondary filters 28 and 38, respectively, as the float valve system 50 precludes water from reaching the filter system 21 in either wet or dry operations by prohibiting a passage of a significant amount of water through the opening 56, as could wet the primary filter 38. As set out above, the primary filter 38 can thereby be formed of a fabric material that is suitable for dry operations such as a polyester material that is also preferred for use for manufacturing the secondary filter 28.

Figure 9:
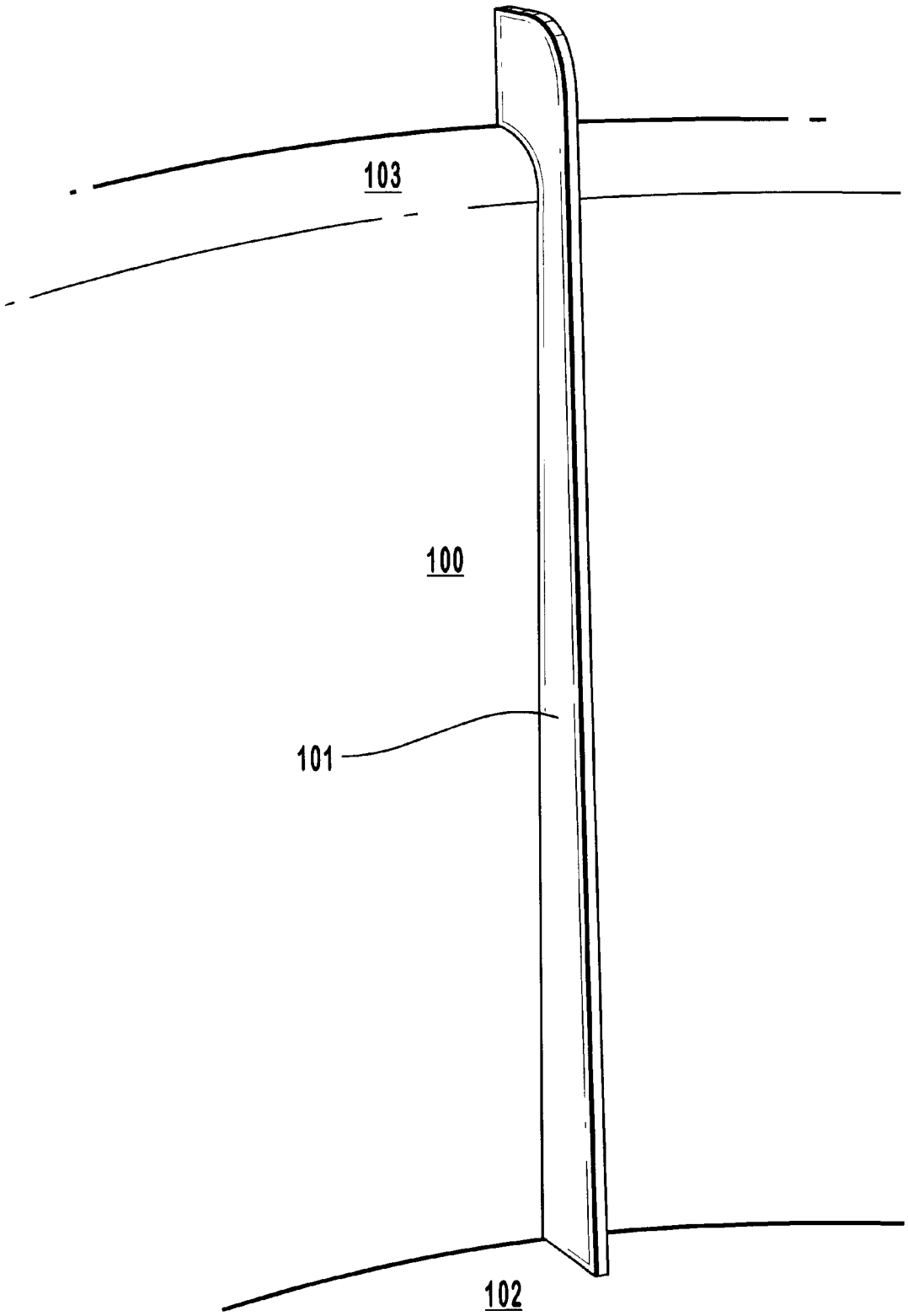
FIG. 9 is an enlarged sectional view taken within the line 9—9 of FIG. 7 showing one of a plurality of vertical ribs secured to the vacuum canister inner wall projecting into to disrupt a circular air flow pulled into the canister during operation.

For directing water as is pulled into canister 12 away from the cage 52, as could ultimately travel through the opening 56, the invention further includes a novel arrangement of a canister inlet port 70, as shown in FIGS. 2, 3, 4A and 4B, and a plurality of vertical flanges 101 mounted at spaced intervals into an inner wall of a canister 100, as shown in FIGS. 6 and 9. The canister inlet port 70 receives an air flow that is pulled into each of the canisters 12 and 100 and directs that flow outwardly, away from the intermediate cover 53. This causes the air flow to be circulates around the housing interior wall. So arranged, items as have been vacuumed up are moved with the spinning air flow and tend to fall out as the air flow loses velocity. The canister inlet port 70 is formed to direct that incoming air flow to travel in a counter clockwise direction though, of course, the port could be formed to where the air flow travels in a clockwise direction, within the scope of this disclosure. The inlet port 70, as shown best in FIGS. 4A and 4B, includes a collar 71 arranged for mounting, as shown in FIGS. 2, 3 and 6, to open through the side of the canisters 12 and 100, and attaches to tubular body 72. The tubular body 72, as shown, includes a longitudinal open section between curved side walls 74 and is partially closed at end 73. So arranged, a flow of air and collected particles or water that enter the canister housing 12 through the inlet port are directed by the inlet port 80, as they pass through the partially closed end 73, at greater than a right angle from the line of that entering flow, shown as arrow A in FIGS. 6 and 7, and towards the canisters 12 and 100 inner wall surface. This provides the above set out circulating flow to additionally de-water the entering flow, arrow A, as shown in FIGS. 6 and 9, the canister 100 inner surface incorporates vertical flanges 101 secured at spaced intervals therearound, extending from the canister bottom 102 to an upper canister section formed at a stepped section 103. So arranged, an entering water containing flow, arrow A, that is directed by inlet port 70 around the canister 100 inner surface strikes the individual vertical flanges 101 that tend to slow and remove energy from that flow, causing entrained water to be separated therefrom and fall to the canister bottom 102 before it can contact the cage 90 straight ribs 92. Accordingly, the combination of the canister vertical flanges 101 and the straight ribs 92 water deflection structures, shown in FIGS. 8A, 8B and 8C, provides for a removal of water entrained in the flow, arrow A, before it can pass through the cage 90 and travel through opening 56 and into the filter system 21.

Further, the location of the inlet port 70, is chosen to discourage a flow of incoming air and water mix that is pulled into the canisters 12 and 100 from traveling to the open sections of the cages 52 and 90. Accordingly, the inlet port 70, as shown in FIGS. 2, 3 and 6, is fitted through the canister 12 wall such that its closed end 73 will be proximate to the intermediate cover 53 vertical wall 54, so as to just extend beyond the wall 54 bend 54*a*. Below which bend 54*a,* as shown, the vertical wall 54 slopes downwardly and inwardly forming the straight bottom section 55. So arranged, water, as is pulled through the inlet port 70, is directed away from the intermediate cover 53. So directed, when that incoming water flow loses velocity, it will have traveled to where it is spaced apart from the inwardly sloping straight cover bottom section 55. The collected water is thereby prohibited from collecting on the intermediate cover 53 as could create a water flow that enters the cages 52 or 90 to be pulled through the opening 56. Both the structure of the inlet port 70 and its location relative to the intermediate cover 53 are therefore also features of the invention that separate water from the vacuum flow, arrow A.

Additionally, the wet and dry vacuum 10 of the invention, as shown in FIGS. 1 and 6, preferably include an accessory tray 80 that, is shown best in FIG. 1, formed a thick bar 81 that is mounted to extend outwardly from the side of canister 12 and includes a plurality of spaced apart cylindrical compartments 82 formed therein that are to receive vacuum tools, not shown. The compartments 82, as best shown in FIGS. 2 and 3, may be closed by a flat bottom 83 formed thereacross, or may be open, within the scope of this disclosure. Also, as mentioned above, the wet and dry vacuum 10, shown in FIGS. 2, 3, and 6, may and preferably is mounted of casters 85, to roll freely across a surface for repositioning and, to simplify lifting, and may, and preferably does, include the pair of handles 86, shown in FIG. 1, as set out above.

It should be understood that, while preferred embodiments of our invention in a wet and dry vacuum have been shown and described herein, the present disclosure is made by way of example only and that variations and changes thereto are possible without departing from the invention subject matter, and a reasonable equivalency thereof, that come within the scope of the following claims, which claims we regard as our invention.

We claim:

1. A wet and dry vacuum comprising, a housing that is open across a top end, is closed across a bottom end, and includes a tangential inlet port means for receiving a vacuum hose to direct inlet materials as are pulled through said vacuum hose into said housing to impart a tangential flow to said inlet materials; a lid arranged for fitting over and releasably connecting to an open top that mounts a vacuum source thereon; a filter system maintained upstream from said vacuum source; an intermediate cover surrounding said filter system and secured along a cover top end in said lid, and is bent inwardly from a mid-section thereof to slope to a center section that has a hole formed therethrough; and a float valve system maintained across said hole upstream from said filter system and includes a cage means that is secured at a cage means top edge to said intermediate cover, around said center section hole, is closed across its bottom with a plurality of spaced straight ribs extending between a cage means upper section and said bottom that are open therebetween, with each said straight rib having a flat outer face with at least one water deflection means formed longitudinally in said rib flat outer face to trap water droplets entained in a tangential vacuum flow directed thereacross, and which said cage means contains a float ball that has a greater diameter than that of said center section hole.

2. A wet and dry vacuum as recited in claim 1, wherein the water deflection means is a straight section of material that is flat on both surfaces and projects outwardly from along the straight rib outer surface longitudinal axis.

3. A wet and dry vacuum as recited in claim 1, wherein the water deflection means is a groove formed into the straight rib outer surface along its longitudinal axis.

4. A wet and dry vacuum as recited in claim 1, where the water deflection means is a pair of parallel straight sections of material that each having flat outer surfaces, are of different heights, are spaced equally apart, and are secured to extend outwardly from the straight rib outer surface longitudinal axis.

5. A wet and dry vacuum as recited in claim 4, further including a groove formed into the straight rib outer surface along its longitudinal axis between the pair of straight sections of material.

6. A wet and dry vacuum as recited in claim 1, wherein the lid edge includes a plurality of clamp means secured at intervals therearound for releasably engaging an outturned lip of the housing; the vacuum source is a vacuum motor secured to a mount that includes, around an outer edge thereof, a plurality of clamp means secured at intervals to releasably connect to an edge of a center hole formed through said lid; the filter system includes primary and secondary filters connected, respectively, to primary and secondary filter mounts that extend, respectively, each from said mount and said lid undersurface to receive, respectively, neck areas of said filters that are each formed as bags and including a clamping ring means for fitting over each said mount to clamp each said filter neck area against surfaces of said mount; and including a filter support maintained between said primary and secondary filters with means for moving said filter support.

7. A wet and dry vacuum as recited in claim 6, wherein the filter support is formed as a rigid frame that is connected to an end of a straight rod as a means for shaking said filter support having an opposite end section for fitting through an opening formed through the vacuum source mount; and including a cover means for fitting over said rod end that is releasably maintained to said vacuum source mount to close off said opening.

8. A wet and dry vacuum as recited in claim 1, wherein the primary and secondary filters are each manufactured from a polyester material.

9. A wet and dry vacuum as recited in claim 1, wherein the inlet port means is a straight sleeve that includes a bend therein and is located adjacent to the intermediate cover, to provide the tangential flow directed towards the housing wall, and has a collar end including means for mounting said straight sleeve in an opening formed through the housing, with said straight sleeve extending alongside the intermediate cover, towards said housing lid where said intermediate cover is bent inwardly, with said sleeve including a right angle rounded bottom end at its best portion to direct the entering materials into said tangential flow and is positioned alongside said intermediate cover, and which said sleeve is open longitudinally from across a portion of said bottom end to a location therealong that is proximate to said collar end.

10. A wet and dry vacuum as recited in claim 9, wherein the opposing edges of the longitudinal opening in the inlet port sleeve are each curved inwardly from the sleeve rounded end to approximately the collar end, and which said opposing edges align with one another.

11. A wet and dry vacuum as recited in claim 1, further including a drain means formed as a half tubular section within a bottom of said housing, and extending from the center of said housing bottom to said housing bottom outer edge, and including a valve means fitted through a wall of said housing that can be opened to pass a liquid flow.

12. A wet and dry vacuum as recited in claim 11, wherein the valve means includes a threaded coupling end secured to the half tubular section end that fits through the canister and which said threaded coupling end includes a transverse wall formed across its forward end that includes a center opening and has at least one port means inset into an edge of said hole; and a sleeve means arranged for turning onto said coupling end to move a flat face of a stop means into and out of engagement with said wall around said hole to close off and open flow through said port means.

13. A wet and dry vacuum as recited in claim 12, wherein the stop means is a cylinder whose sides connect to ends of a spider means that extends to and connects to the sleeve wall, said spider to pass the flow therethrough; and the port means is a plurality of notches formed at spaced intervals into the edge of the coupling end wall opening.

14. A wet and dry vacuum as recited in claim 1, further including at least one straight rib means mounted vertically to a housing inner wall to extend outwardly from a housing inner wall and into the path of the tangential flow of materials pulled through the inlet port means into said housing.

15. A wet and dry vacuum as recited in claim 14, wherein a plurality of rib means are mounted at spaced intervals to extend outwardly from the housing inner wall from a bottom of the housing upwardly to a housing mid-section.

16. A wet and dry vacuum as recited in claim 1, further including an accessory tray formed as a flat section that is rounded around a connecting surface for joining onto the side of the housing, and, said flat section including a plurality of cups or openings formed at spaced intervals in a top surface thereof.

17. A wet and dry vacuum as recited in claim 1, wherein the filter system cage means closed bottom slopes slightly downwardly and inwardly to a center wherein a drain opening is formed.

* * * * *